US012759826B2

(12) United States Patent
Miyagawa

(10) Patent No.: US 12,759,826 B2
(45) Date of Patent: Oct. 13, 2026

(54) SHEET CONVEYOR AND IMAGE FORMING APPARATUS

(71) Applicant: Hiroaki Miyagawa, Kanagawa (JP)

(72) Inventor: Hiroaki Miyagawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 212 days.

(21) Appl. No.: 18/672,038

(22) Filed: May 23, 2024

(65) Prior Publication Data

US 2024/0391718 A1 Nov. 28, 2024

(30) Foreign Application Priority Data

May 25, 2023 (JP) ..... 2023-086383

(51) Int. Cl.
*B41J 11/04* (2006.01)
*B65H 5/22* (2006.01)

(52) U.S. Cl.
CPC ..... *B65H 5/226* (2013.01); *B65H 2406/33* (2013.01)

(58) Field of Classification Search
CPC . B41J 11/00; B41J 11/04; B41J 11/057; B41J 13/076; B65H 5/226; B65H 2406/33; G03G 15/75; G03G 15/751; G03G 2215/1619
USPC ..... 399/117, 303
See application file for complete search history.

(56) References Cited

U.S. PATENT DOCUMENTS 4,437,659 A * 3/1984 Caron ..... B65H 5/226 271/276
6,076,921 A * 6/2000 Rezanka ..... B41J 11/04 347/102
6,254,081 B1 * 7/2001 Rasmussen ..... B41J 13/226 271/96
8,474,970 B2 * 7/2013 Yamanobe ..... B41J 11/057 347/17
8,545,007 B2 * 10/2013 Fukui ..... B41J 13/223 347/101
9,216,595 B1 12/2015 Piatt et al.
11,220,410 B2 * 1/2022 Miyagawa ..... B41J 13/226
11,279,580 B2 * 3/2022 Miyagawa ..... B65H 5/222
11,673,755 B2 * 6/2023 Miyagawa ..... B65H 5/222 271/276

(Continued)

FOREIGN PATENT DOCUMENTS

JP H07-228383 A 8/1995
JP 2001-206585 A 7/2001
JP 2020-019637 A 2/2020

OTHER PUBLICATIONS

Extended European Search Report issued Oct. 21, 2024 in European Patent Application No. 24177287.0, 10 pages.

*Primary Examiner* — Leslie A Nicholson, III
(74) *Attorney, Agent, or Firm* — XSENSUS LLP

(57) ABSTRACT

A sheet conveyor includes: a drum to: carry a sheet on a circumferential surface of the drum; and rotate to convey the sheet; and adhering part to adhere the sheet to the circumferential surface of the drum, wherein the drum has: both end parts in an axial direction of the drum, the both end parts each having a first outer diameter in a radial direction orthogonal to the axial direction; and a center part between the both end parts in the axial direction of the drum, the center part having a second outer diameter smaller than the first outer diameter in the radial direction.

16 Claims, 6 Drawing Sheets

(56) References Cited

U.S. PATENT DOCUMENTS

| | | | | |
|---|---|---|---|---|
| 11,724,528 | B2 * | 8/2023 | Miyagawa | B41J 11/003 271/275 |
| 11,912,020 | B2 * | 2/2024 | Miyagawa | B65H 5/226 |
| 11,975,939 | B2 * | 5/2024 | Miyagawa | B41J 11/0085 |
| 2011/0157289 | A1 | 6/2011 | Yamanobe | |
| 2012/0019606 | A1 | 1/2012 | Fukui | |
| 2020/0039772 | A1 | 2/2020 | Miyagawa | |

* cited by examiner

SHEET CONVEYOR AND IMAGE FORMING APPARATUS

CROSS-REFERENCE TO RELATED APPLICATION

This patent application is based on and claims priority pursuant to 35 U.S.C. § 119 (a) to Japanese Patent Application No. 2023-086383, filed on May 25, 2023, in the Japan Patent Office, the entire disclosure of which is hereby incorporated by reference herein.

BACKGROUND

Technical Field

The present embodiment relates to a sheet conveyor and an image forming apparatus.

Related Art

A sheet conveyor includes a conveying drum that carries a sheet on its circumferential surface, rotates, and conveys the sheet and close-contact means that brings the sheet into close contact with the circumferential surface of the conveying drum.

An image forming apparatus including the sheet conveyor described above. The image forming apparatus causes the circumferential surface of the conveying drum in the sheet conveyor described above to carry a sheet fed from a sheet feeding unit, conveys the sheet to a printing region facing a liquid discharge head, and forms an image on the sheet in the printing region. The sheet conveyor conveys the sheet on which the image is formed to a dryer. The dryer then dries the image formed on the sheet. A sheet that the dryer has dried may be reversed and conveyed again to the printing region to make images printable on both sides of the sheet.

However, when a sheet is brought into close contact with the circumferential surface of the conveying drum, wrinkles may be generated at ends, in width directions, of the sheet.

SUMMARY

In an aspect of the present disclosure, a sheet stacker includes: a loader to which a sheet bundle is to be loaded; a guide to: receive a leading end of a sheet conveyed to an area above the loader; and guide the sheet along a guide path above the loader in a conveyance direction; a blower disposed above the guide path of the guide to blow air downward to the sheet; and multiple lines: disposed above the guide path of the guide; and extending in a direction inclined relative to the conveyance direction.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
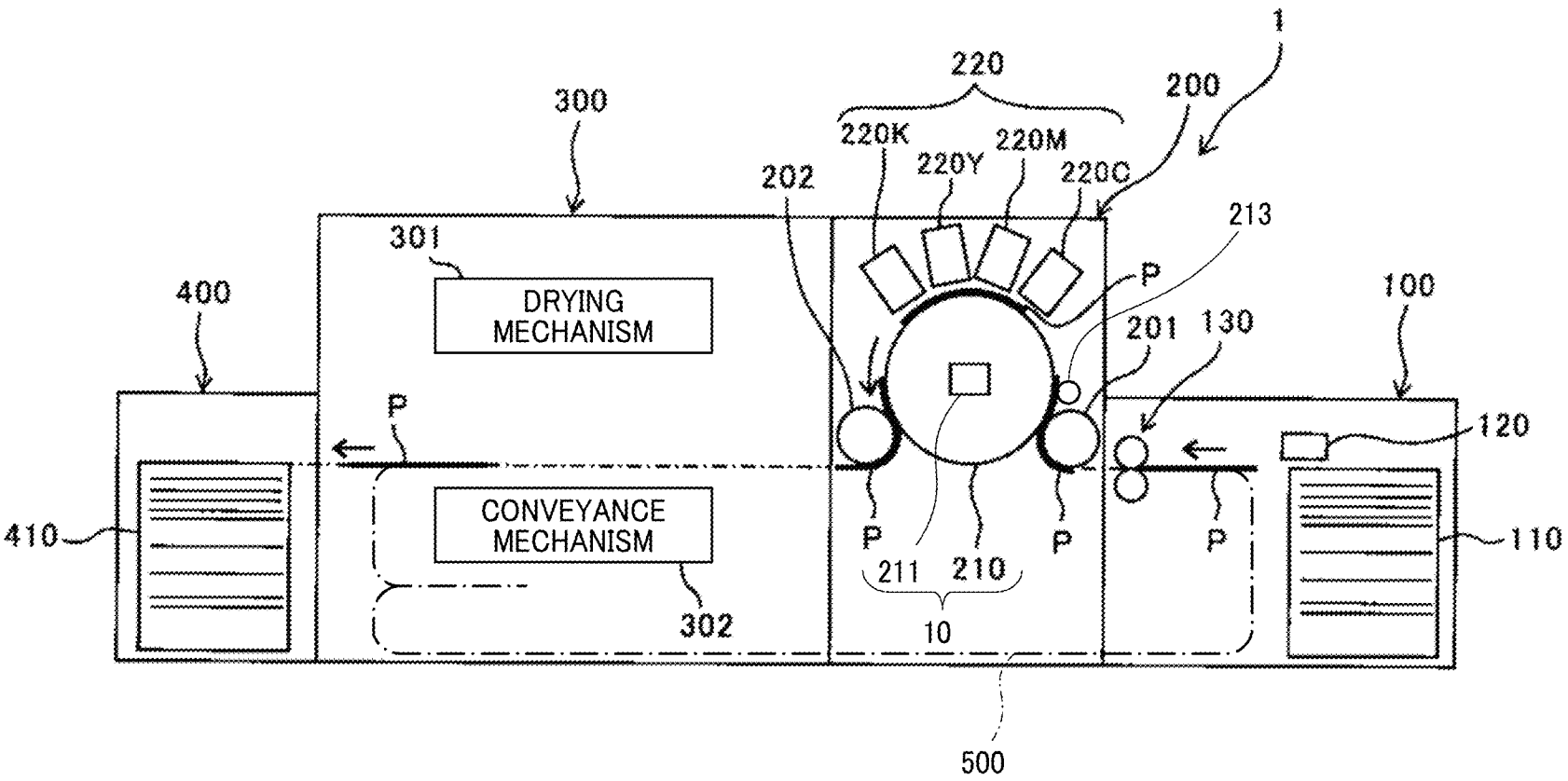
FIG. 1 is a schematic view illustrating an outline configuration of an inkjet recording apparatus serving as an image forming apparatus according to a present embodiment.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A best mode for carrying out the present embodiment will now be described herein with reference to the drawings. It is to be understood that those skilled in the art can easily modify and change the present embodiment within the scope of the appended claims to form other embodiments, and these modifications and changes are included in the scope of the appended claims. The following description is an example of the best mode of the present embodiment, and does not limit the scope of the claims.

Overall Description

FIG. 1 is a schematic view illustrating an outline configuration of an inkjet recording apparatus serving as an image forming apparatus according to the present embodiment.

An inkjet recording apparatus 1 according to the present embodiment mainly includes a sheet feeding unit 100, an image forming unit 200, a drying unit 300, and a sheet ejection unit 400. The inkjet recording apparatus 1 uses inks, which are liquids that the image forming unit 200 uses to form an image, to form an image on a sheet P that is a recording material serving as a sheet that the sheet feeding unit 100 feeds. After the drying unit 300 has caused the inks applied on the sheet to dry, the sheet ejection unit 400 ejects the sheet.

Sheet Feeding Unit

The sheet feeding unit 100 mainly includes a sheet feeding tray 110 on which multiple sheets P is stacked, a feeding device 120 that separately feeds the sheet one by one from the sheet feeding tray 110, and a registration roller pair 130 that feeds the sheet to the image forming unit 200. Any feeding device such as a device using a roller or a device using air suction may be used as the feeding device 120. A sheet that the feeding device 120 has fed from the sheet feeding tray 110, as its leading end has reached the registration roller pair 130 and the registration roller pair 130 has been driven at a predetermined timing, is fed to the image forming unit 200. As long as the sheet feeding unit 100 feeds a sheet P to the image forming unit 200, there is no limitation in configuration in the present embodiment.

Image Forming Unit

The image forming unit 200 mainly includes a receiving cylinder 201 that receives a sheet P that has been fed and a sheet conveyor 10 including a sheet carrying drum 210 serving as a conveying drum that carries, on its outer circumferential surface, and conveys the sheet P that the receiving cylinder 201 has conveyed. Also included are a pressing roller 213 that presses a sheet P that the outer circumferential surface of the sheet carrying drum 210 carries against the outer circumferential surface of the sheet carrying drum 210 and an ink discharging unit 220 that discharges inks toward the sheet P that the sheet carrying drum 210 carries. Further included is a transfer cylinder 202 that transfers the sheet P that the sheet carrying drum 210 has conveyed to the drying unit 300. The sheet conveyor 10 includes a suction device 211 serving as close-contact means and suction means that suck and bring a sheet Pinto close contact with the outer circumferential surface of the sheet carrying drum 210. The suction device is an example of an adhering part to adhere the sheet to the drum 210.

The leading end of the sheet P conveyed from the sheet feeding unit 100 to the image forming unit 200 is gripped by a sheet gripper disposed on the surface of the receiving cylinder 201. The sheet P is conveyed along with the movement of the surface of the receiving cylinder 201. The sheet P conveyed by the receiving cylinder 201 is delivered to the sheet carrying drum 210 at a position facing the sheet carrying drum 210.

A sheet gripper is also provided on a surface of the sheet carrying drum 210. The sheet gripper thus grips the leading end of a sheet. Multiple suction holes is also dispersedly formed on the surface of the sheet carrying drum 210. In each of the suction holes, the suction device 211 generates a suction airflow heading into the sheet carrying drum 210. The sheet gripper grips the leading end of the sheet P delivered from the receiving cylinder 201 to the sheet carrying drum 210. After the pressing roller 213 has pressed the sheet P against the outer circumferential surface of the sheet carrying drum 210, the suction airflows generated by the suction device 211 cause the sheet P to be sucked to the surface of the sheet carrying drum 210. The sheet P is thus conveyed as the surface of the sheet carrying drum 210 moves.

The ink discharging unit 220 according to the present embodiment discharges inks in four colors that are C (cyan), M (magenta), Y (yellow), and K (black) to form an image. The ink discharging unit 220 includes, separately, liquid discharge heads 220C, 220M, 220Y, and 220K for the inks in colors. The liquid discharge heads 220C, 220M, 220Y, and 220K are not limited in configuration, as long as the heads discharge liquids. The liquid discharge heads may adopt any configurations. A liquid discharge head that ejects special ink such as white, gold and, silver may be provided, or a liquid discharge head that ejects a surface coating liquid that does not form an image may be provided, as necessary.

Drive signals corresponding to image information control the liquid discharge heads 220C, 220M, 220Y, 220K in the ink discharging unit 220 in discharge operation. When the sheet P that the sheet carrying drum 210 is carrying passes through a region facing the ink discharging unit 220, the liquid discharge heads 220C, 220M, 220Y, and 220K discharge the inks in the colors, respectively, to form an image corresponding to the image information. In the present embodiment, the image forming unit 200 is not limited in configuration, as long as liquids are applied onto a sheet P to form an image.

Drying Unit

The drying unit 300 mainly includes a drying mechanism 301 for drying the inks that the image forming unit 200 has applied on a sheet P and a conveyance mechanism 302 for conveying the sheet P conveyed from the image forming unit 200. The conveyance mechanism 302 receives the sheet P conveyed from the image forming unit 200. The sheet P being conveyed passes through the drying mechanism 301. The sheet P is thus delivered to the sheet ejection unit 400. When passing through the drying mechanism 301, the inks on the sheet P undergo a drying process. Liquid components such as moisture in the inks evaporate. The inks thus adhere to the sheet P. Curling of the sheet P is also suppressed.

Sheet Ejection Unit

The sheet ejection unit 400 mainly includes a sheet ejection tray 410 on which the plurality of sheets P is to be stacked. The sheets P conveyed from the drying unit 300 are sequentially stacked and held on the sheet ejection tray 410. As long as the sheet ejection unit 400 ejects a sheet P, there is no limitation in configuration in the present embodiment.

Other Functional Units

The inkjet recording apparatus 1 according to the present embodiment includes the sheet feeding unit 100, the image forming unit 200, the drying unit 300, and the sheet ejection unit 400. The inkjet recording apparatus 1 according to the present embodiment may be appropriately added with other functional units. For example, a pre-processing device that performs pre-processing for forming an image may be added between the sheet feeding unit 100 and the image forming unit 200. A post-processing device that performs post-processing for forming an image may be added between the drying unit 300 and the sheet ejection unit 400.

An example of the pre-processing device performs a processing liquid applying operation to apply processing liquid onto the sheet P so as to reduce bleeding by reacting with ink. However, the content of the pre-processing operation is not limited particularly. Example processing that the post-processing device performs may also be processing of binding multiple sheets on which images are formed. However, processing that the post-processing device performs is not limited in particular in content.

The inkjet recording apparatus 1 according to the present embodiment further includes a reverse conveyance mechanism 500.

To record images on both the sides of a sheet, the sheet that has once passed through the drying mechanism 301 is conveyed to the reverse conveyance mechanism 500. The sheet conveyed to the reverse conveyance mechanism 500 is switched back and conveyed again to the registration roller pair 130. As the leading end, in a conveyance direction, of the sheet has reached the registration roller pair 130 and the registration roller pair has been driven at a predetermined timing, the sheet is conveyed again to the ink discharging unit 220. An image is thus formed on the other surface of the sheet.

In the present embodiment, a printing apparatus is described as the inkjet recording apparatus as an example. However, the "printing apparatus" is not limited to an apparatus including a liquid discharge head that discharges a liquid toward a surface of a sheet material, which is to be dried, and in which the discharged liquid visualizes a meaningful image such as a character or a figure. The present embodiment also includes, for example, an apparatus that forms a pattern or the like having no meaning in itself. The sheet material is not limited in material. The sheet material may be any material to which a liquid is attachable, even temporarily. Examples of the sheet material include paper, thread, fiber, cloth, leather, metal, plastic, glass, wood, ceramics, and the like. For example, the sheet material may be used for film products, cloth products for clothing and the like, building materials such as wall paper and floor materials, leather products, and the like. The "printing apparatus" may include devices to feed, convey, and eject the material on which liquid can adhere. The printing apparatus may further include a pretreatment apparatus to coat a treatment liquid onto the material, and a post-treatment apparatus to coat a treatment liquid onto the material, onto which the liquid has been discharged.

Further, the term "liquid" includes any liquid having a viscosity or a surface tension that is dischargeable from the head. However, preferably, the viscosity of the liquid is not greater than 30 mPa·s under ordinary temperature and ordinary pressure or by heating or cooling. More specifically, the liquid is a solution, a suspension, an emulsion, or the like containing a solvent such as water or an organic solvent, a colorant such as a dye or a pigment, a function-imparting material such as a polymerizable compound, a resin, or a surfactant, a biocompatible material such as deoxyribonucleic acid (DNA), amino acid, protein, or calcium, an edible material such as a natural pigment, or the like. For example, these examples can be used for an inkjet ink, a surface treatment liquid, or the like.

The "printing apparatus" also includes, but not limited to, an apparatus in which a liquid discharge head and a sheet material move relative to each other. Specific examples of such an apparatus include a serial head apparatus that moves a liquid discharge head and a line head apparatus that does not move a liquid discharge head.

The "liquid discharge head" is a functional component that discharges and injects a liquid from a discharge hole (a nozzle). As an energy generation source for ejecting liquid, ejection energy generation means can be used, such as a piezoelectric actuator (laminated piezoelectric element and thin film piezoelectric element), a thermal actuator using an electrothermal transducer such as a heating resistor, or an electrostatic actuator including a diaphragm and a counter electrode. However, the ejection energy generation means to be used is not limited.

Figure 2:
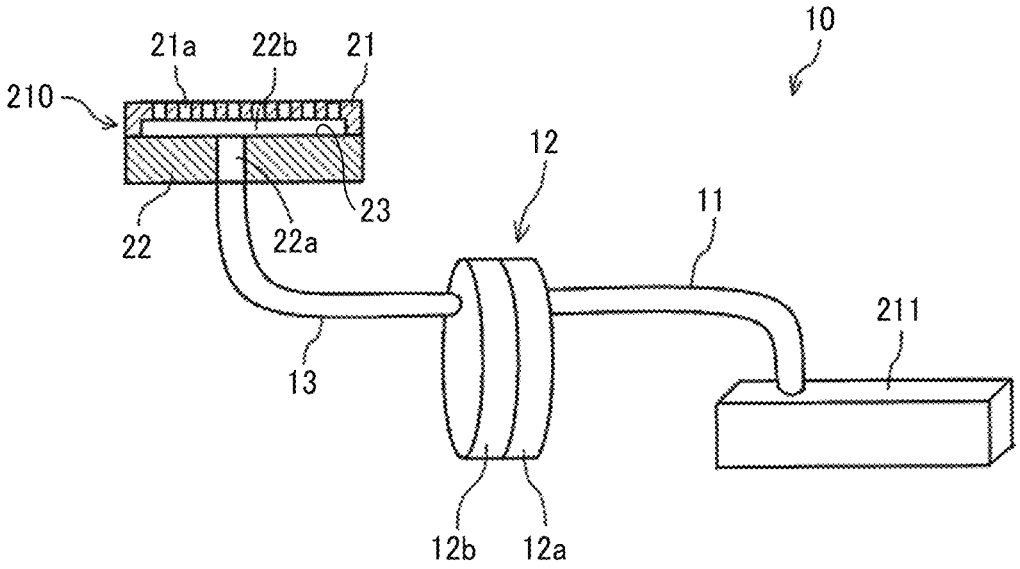
FIG. 2 is a schematic view illustrating a general arrangement of a sheet conveyor.
Figure 3:
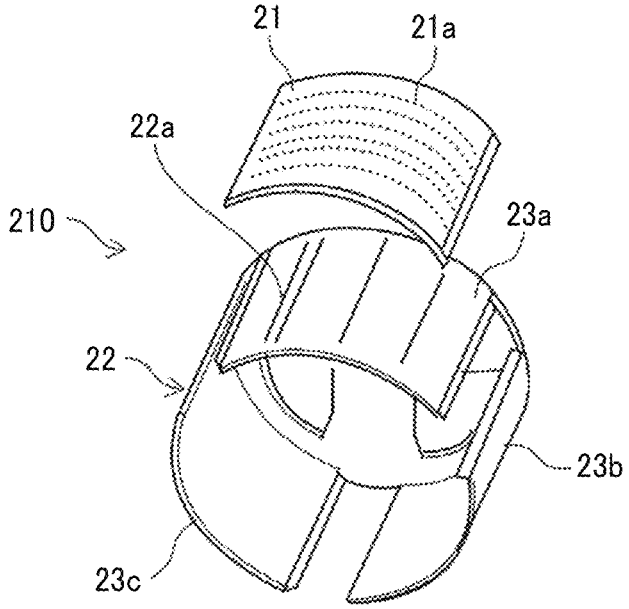
FIG. 3 is an exploded perspective view illustrating a main part of a sheet carrying drum.

FIG. 2 is a schematic view illustrating a general arrangement of the sheet conveyor 10. FIG. 3 is an exploded perspective view illustrating a main part of the sheet carrying drum 210.

The sheet conveyor 10 includes the suction device 211, the sheet carrying drum 210, and a rotary valve 12 serving as a suction region switching device disposed between the suction device 211 and the sheet carrying drum 210. The suction device 211 and the rotary valve 12 communicate with each other through a hose (tube) 11. The rotary valve 12 communicates with chambers 22*b* in the sheet carrying drum 210 through a hose (tube) 13.

As illustrated in FIGS. 2 and 3, the sheet carrying drum 210 includes a drum body 22 and suction plates 21. As illustrated in FIG. 3, the drum body 22 has three sheet carrying regions 23*a*, 23*b*, and 23*c* for carrying a sheet P in circumferential directions. In each of the sheet carrying regions 23*a* to 23*c*, multiple suction grooves 22*a* extending in directions of a rotation axis of the sheet carrying drum 210 (also width directions of a sheet) is formed. The hose 13 is coupled to each of the suction grooves 22*a*. As the suction plates 21 having suction holes 21*a* are attached to the sheet carrying regions 23*a* to 23*c*, respectively, the chambers 22*b* through which each of the suction holes 21*a* communicates with each of the sheet carrying regions 23*a* to 23*c* are formed. The drum body 22 has a cylindrical shape and is an example of a cylinder.

Figure 4:
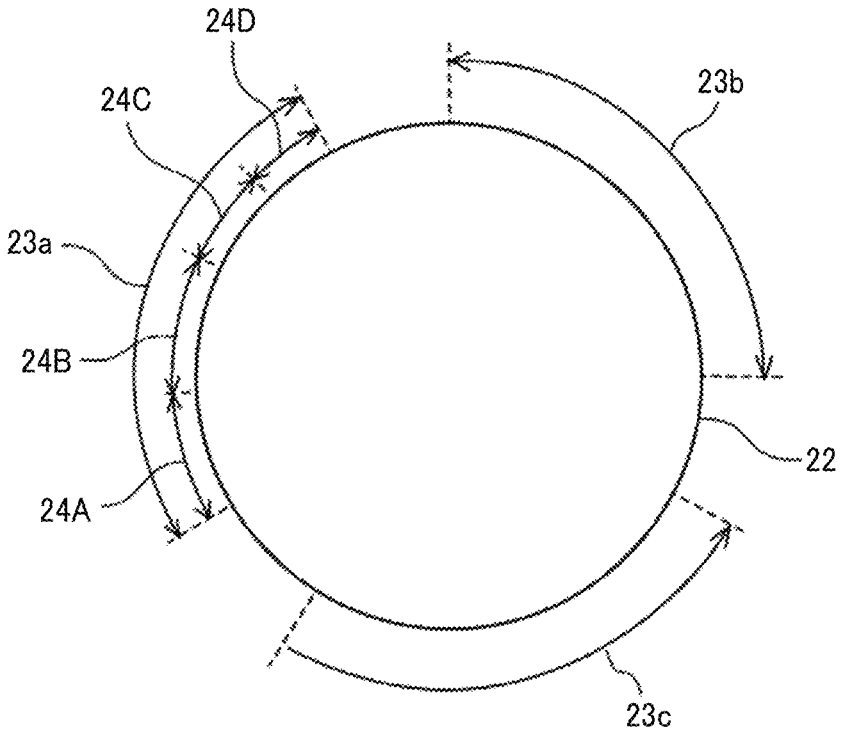
FIG. 4 is an explanatory diagram for explaining multiple suction regions in a sheet carrying region on the sheet carrying drum.

As illustrated in FIG. 4, each of the sheet carrying regions 23*a* to 23*c* has four suction regions 24A, 24B, 24C, and 24D that suck a sheet P in the circumferential directions. At least one of the suction grooves 22*a* is disposed in each of the suction regions. As switching takes place in the rotary valve 12 among the suction grooves 22*a* that each generate a suction airflow, switching takes place in suction region among the suction regions 24A to 24D.

In the present embodiment, as described below, the suction region where a sheet is sucked is sequentially expanded from a downstream side in the sheet conveyance direction. The sheet P fed from the receiving cylinder 201 by the sheet feeding unit 100 is brought into close contact with the outer circumferential surface of the sheet carrying drum 210. Specifically, when the first suction region 24A has reached a position where the pressing roller 213 presses the sheet P against the outer circumferential surface of the sheet carrying drum 210, a suction airflow is generated in the first suction region 24A. A part of the sheet carried in the sheet carrying region 23, which is located in the first suction region 24A, is thus sucked to the surface of the sheet carrying drum 210. Next, when the second suction region 24B has reached the position where the pressing roller 213 presses the sheet P against the outer circumferential surface of the sheet carrying drum 210, a suction airflow is generated in the second suction region 24B. The part, which is located in the first suction region 24A, and the part, which is located in the second suction region 24B, of the sheet are accordingly sucked to the surface of the sheet carrying drum 210. Next, when the third suction region 24C has reached the position where the pressing roller 213 presses the sheet P against the outer circumferential surface of the sheet carrying drum 210, a suction airflow is generated in the third suction region 24C. The part, which is located between the first suction region 24A and the third suction region 24C, of the sheet is accordingly sucked to the surface of the sheet carrying drum 210. When the fourth suction region 24D has reached the position where the pressing roller 213 presses the sheet P against the outer circumferential surface of the sheet carrying drum 210, a suction airflow is generated in the fourth suction region 24D. The sheet is thus wholly sucked to the outer circumferential surface of the sheet carrying drum 210.

The suction region within which suction takes place is changed depending on a length of a sheet in the conveyance direction. For example, when a length of a sheet in the conveyance direction is short and a trailing end of the sheet is located in the third suction region 24C, no air flow is generated in the fourth suction region 24D.

Regarding transferring from the sheet carrying drum 210 to the transfer cylinder 202, on the other hand, the suction region is sequentially reduced from the downstream side in the sheet conveyance direction. That is, when the first suction region 24A has reached a delivery region for the sheet from the sheet carrying drum 210 to the transfer cylinder 202, suction in the first suction region 24A is stopped. Next, when the second suction region 24B has reached the delivery region, suction in the second suction region 24B is stopped. When the suction region has reached a delivery region, suction in the suction region is thus stopped. In a state where a trailing end side of a sheet is brought into firm, close contact with the outer circumference of the sheet carrying drum 210, a leading end side of the sheet can be accordingly and smoothly delivered to the transfer cylinder 202.

Figure 5A:
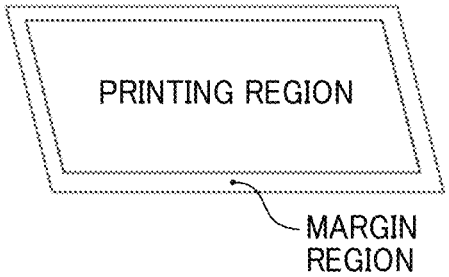
FIG. 5A is a view illustrating a state of a sheet before passing through the dryer.
Figure 5B:
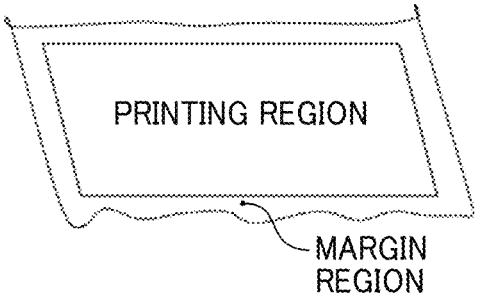
FIG. 5B is a view illustrating a state of the sheet after passing through the dryer.

As illustrated in FIG. 5A, margins are generally provided at the leading end, the trailing end, and both ends, in the width directions, of a sheet for providing a margin for each of the sheet grippers and for performing post-processing (binding processing, cutting processing, perforation processing, and the like). As the drying unit 300 causes the sheet to dry, a printing region in the sheet contracts more than a margin region. As a result, a length in the sheet conveyance direction at each of the ends, in the width directions, of the sheet becomes longer than a length at a center. Distortion may occur in the sheet. As illustrated in FIG. 5B, waviness (hereinafter, referred to as end waviness) may occur at the ends, in the width directions, of the sheet. In a case of thin paper, in particular, end waviness as described above is likely to occur. When double-sided printing is to be performed, a sheet that has dried in the drying mechanism 301 in the drying unit 300 is conveyed again in the present embodiment, as illustrated in FIG. 1. The sheet, on which end waviness has occurred, as illustrated in FIG. 5B, may thus be conveyed again. When a sheet on which end waviness has occurred is brought into close contact with the outer circumferential surface of the sheet carrying drum 210 having a constant outer diameter in the sheet width directions, wrinkles may be generated at the ends in the sheet width directions.

In the present embodiment, outer diameters at both ends of the outer circumferential surface of the sheet carrying drum 210 are each formed larger than an outer diameter at a center. A length, in the circumferential directions, at both the ends, in the sheet width directions, of the sheet carrying drum 210 is accordingly longer than a length, in the circumferential directions, at the center. Even when a length, in the conveyance direction, at each of the ends, in the width directions, of a sheet is longer than a length at the center, and end waviness has occurred on the sheet at both the ends in the width directions, it is accordingly possible to three-dimensionally fit the sheet to the outer circumferential surface of the sheet carrying drum 210. It is also possible to bring the ends, in the width directions, of the sheet, which are each in a state of being stretched in the conveyance direction, into close contact with the outer circumferential surface of the sheet carrying drum 210. It is accordingly possible to suppress occurrence of wrinkles at the ends of a sheet. Features of the present embodiment will now be described herein with reference to the drawings.

Figure 6:
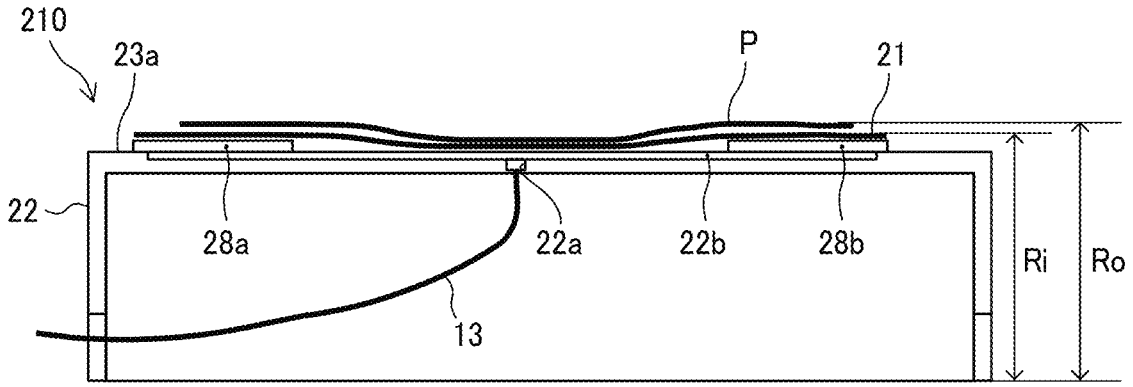
FIG. 6 is a schematic configuration view of the sheet carrying drum according to the present embodiment.

FIG. 6 is a schematic configuration view of the sheet carrying drum according to the present embodiment.

In the present embodiment, the suction plates 21 are flexible members that deform by a suction force of the suction device 211. Spacers 28*a* and 28*b* are provided between both ends, in the sheet width directions (also the directions of the rotation axis of the sheet carrying drum), of each of the suction plates 21 and each of the sheet carrying regions on the drum body 22. The spacers 28*a* and 28*b* are attached at both the ends, in the sheet width directions (also the directions of the rotation axis of the sheet carrying drum), of each of the suction plates 21, using double-sided tapes or the like. A thickness of each of the spacers 28*a* and 28*b* is approximately 0.2 mm.

The suction plates 21 that are the flexible members allow, when a sheet P is brought into close contact with a surface of the suction plate 21, which serves as the outer circumferential surface of the sheet carrying drum 210, by a suction airflow, a center, in the sheet width directions, of the suction plate 21 is bent and concaved by the suction airflow. At least an outer diameter Ro at each of both the ends of a sheet facing-width region on the outer circumferential surface of the sheet carrying drum 210 is accordingly longer than an outer diameter Ri at a center. Even when a length, in the conveyance direction, at each of the ends, in the width directions, of a sheet is longer than a length at the center, and end waviness has occurred on the sheet at both the ends in the width directions, it is therefore possible to three-dimensionally fit the sheet to the outer circumferential surface of the sheet carrying drum 210. Even when waviness has occurred at the ends, in the width directions, of the sheet, the sheet can be accordingly stretched in the conveyance direction and brought into close contact with the outer circumferential surface of the sheet carrying drum 210. It is therefore possible to suppress occurrence of wrinkles at the ends of a sheet.

The sheet facing-width region described above is a maximum width size of a sheet that the present apparatus can convey.

In particular, each of the sheet carrying regions 23*a* to 23*c* is divided into the four suction regions 24A, 24B, 24C, and 24D in the circumferential directions in the present embodiment, as illustrated in FIG. 4. A sheet is thus gradually sucked to the suction plate 21 from its leading end side. Even when waviness has occurred at the ends of a sheet, it is accordingly possible to gradually straighten and stretch the waviness at the ends of the sheet from its leading end side. It is thus possible to preferably suppress occurrence of wrinkles at the ends of the sheet.

In the present embodiment, the spacers 28*a* and 28*b* are provided. Even when the suction plate 21 that is the flexible member is concavely bent in the width directions, the suction plate 21 is thus prevented from coming into contact with a bottom surface of the chamber 22*b* and from blocking the suction grooves 22*a*. The sheet can be accordingly and preferably brought into close contact with the suction plate 21.

As long as at least an outer diameter at a part of the outer circumferential surface of the sheet carrying drum 210, which faces each of the ends, in the width directions, of a sheet, is larger than an outer diameter of a part facing the center, in the width directions, of the sheet, it is possible to bring the sheet into close contact with the outer circumferential surface of the sheet carrying drum 210, without allowing wrinkles to occur at the ends of the sheet, even when a length, in the conveyance direction, at each of the ends, in the width directions, of the sheet is longer than a length at the center, and waviness has occurred on the sheet at both the ends in the width directions. The spacers 28*a* and 28*b* are disposed more inside than ends, in the width directions, of the drum body 22 that is longer than a maximum width of a sheet that the present apparatus can convey in the present embodiment, as illustrated in FIG. 6. An outer diameter at a part, which faces each of the ends, in the width directions, of a sheet, of the outer circumferential surface of the sheet carrying drum 210 is formed to be larger than an outer diameter at a part facing the center, in the width directions, of the sheet.

In the present embodiment, the suction plates 21 are the flexible members, which are caused to concavely bend in the width directions by a suction force of the suction device 211. However, the suction plates 21 may be rigid members each having a certain degree of rigidity against bending by the suction force of the suction device 211 and each having a sheet-close-contact surface that is a concaved surface in which its center is concaved in the width directions in an initial state. In such a configuration, the spacers 28*a* may not be provided.

Figure 7:
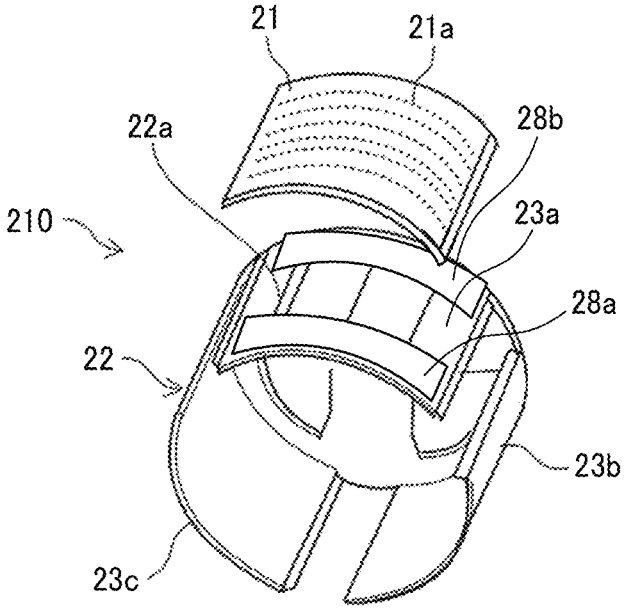
FIG. 7 is a view illustrating an example of applying spacers onto the sheet carrying drum.

The spacers 28*a* and 28*b* have also been attached to both the ends, in the sheet width directions (also the directions of the rotation axis of the sheet carrying drum), of the suction plate 21, using double-sided tapes or the like in the present embodiment. However, spacers may be attached to the sheet carrying regions on the drum body 22, as illustrated in FIG. 7.

When single-sided printing is to be performed, a sheet, in which lengths in the conveyance direction from the sheet feeding unit 100 to both the ends and the center in the width directions are substantially identical to each other, and no end waviness has occurred, comes into close contact with the outer circumferential surface of the sheet carrying drum 210, which has a concaved surface in which its center is concaved. However, a sheet such as thin paper in which end waviness may occur can be locally stretched. A sheet in which end waviness has not yet occurred can therefore be locally stretched when single-sided printing is to be performed to absorb a difference in circumferential length between the ends and the center. The sheet can thus be three-dimensionally fitted to the outer circumferential surface having the concaved surface. As described above, causing each of the suction plates 21 to gradually suck a sheet from the leading end side of the sheet makes it also possible to bring the sheet, in which end waviness has not yet occurred, into close contact with the outer circumferential surface having the concaved surface without causing wrinkles or the like or occur.

When the outer circumferential surface of the sheet carrying drum 210 is formed to be a concaved surface in which the center is concaved in the width directions, distances between a sheet and a nozzle of each of the liquid discharge heads may become different in the width directions. There may thus be a concern about disturbance in linearity of printing and contamination due to satellite scattering. Compared with quality defects such as wrinkles, however, disturbance in linearity of printing and contamination due to satellite scattering may be an acceptable level.

In a case of a sheet material having strong stiffness such as thick paper, sheet distortion is less likely to occur, and end waviness is thus less likely to occur. A sheet material having strong stiffness such as thick paper may not also deform along the concaved surface in which the center is concaved in the width directions when the sheet-close-contact surface of each of the suction plates 21 is in the initial state, and may not come into close contact with the outer circumferential surface of the sheet carrying drum.

Figure 8A:
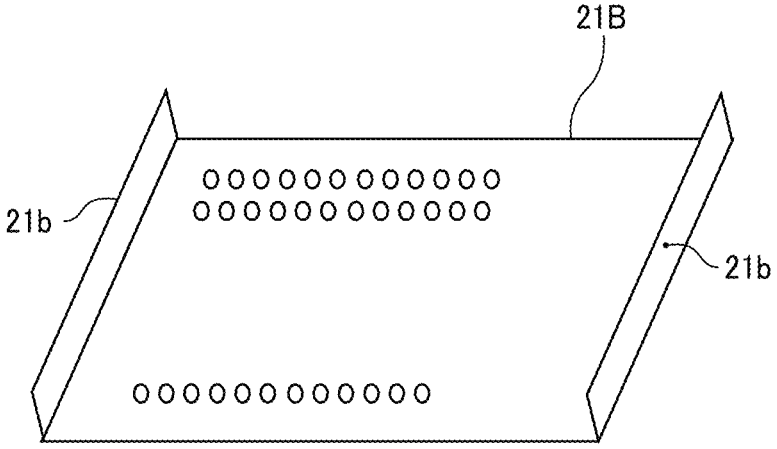
FIG. 8A is a schematic perspective view illustrating a rigid suction plate.
Figure 8B:
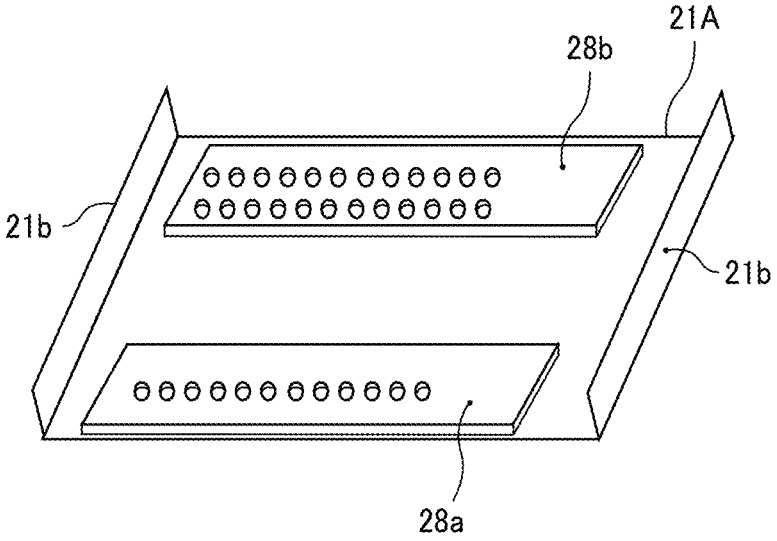
FIG. 8B is a schematic perspective view illustrating a flexible suction plate.

The suction plates 21 can therefore be attached to and detached from the drum body 22. Switching may be allowed between flexible suction plates 21A that are flexible members to which the spacers 28*a* and 28*b* are attached, respectively, at ends in the width directions illustrated in FIG. 8B and rigid suction plates 21B to which the spacers illustrated in FIG. 8A are not attached and which each have rigidity to an extent that no bending occurs even when the suction force of the suction device 211 is applied.

Figure 9:
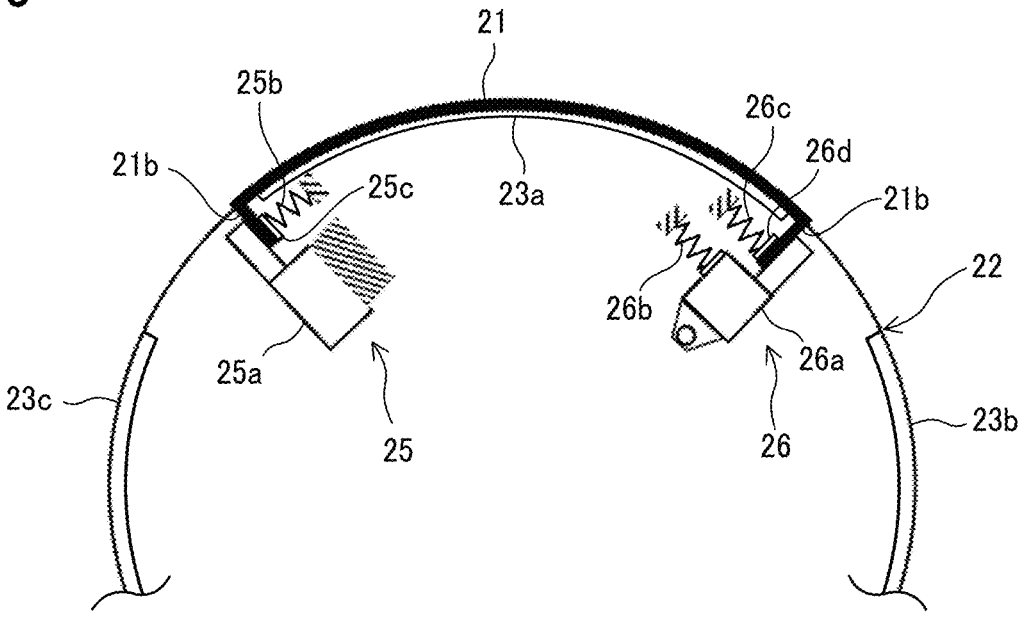
FIG. 9 is a schematic view illustrating a securing structure for attachably and detachably securing the suction plate to the drum body.

FIG. 9 is a schematic view illustrating a securing structure for attachably and detachably securing the suction plates 21 to the drum body 22.

Attached portions 21*b* that are bent inwardly are provided at both the ends, in the sheet conveyance direction, of the suction plate 21. One end, in the circumferential directions, in each of the sheet carrying regions 23*a* to 23*c* on the drum body 22 is provided with a suction plate leading end securing portion 25 that sandwiches and secures one of the attached portions 21*b*, which lies on a leading end side, in the sheet conveyance direction, of the suction plate 21. Another end, in the circumferential directions, of each of the sheet carrying regions 23*a* to 23*c*, is provided with a suction plate trailing end securing portion 26 that sandwiches and secures another one of the attached portions 21*b*, which lies on a trailing end side, in the sheet conveyance direction, of the suction plate 21.

The suction plate leading end securing portion 25 includes a leading end pressed member 25*a* against which the attached portion 21*b* on the leading end side of the suction plate 21 is pressed and a leading end pressing member 25*c* that presses the attached portion 21*b* on the leading end side of the suction plate 21 against the leading end pressed member 25*a*. The leading end pressing member 25*c* is held by one end of a spring 25*b*. With a biasing force of the spring 25*b*, the leading end pressing member 25*c* presses the attached portion 21*b* on the leading end side of the suction plate 21 against the leading end pressed member 25*a*. The attached portion 21*b* on the leading end side of the suction plate 21 is accordingly sandwiched and secured between the leading end pressing member 25*c* and the leading end pressed member 25*a*.

The suction plate trailing end securing portion 26 includes a trailing end pressed member 26*a* against which the attached portion 21*b* on the trailing end side of the suction plate 21 is pressed and a trailing end pressing member 26*d* that presses the attached portion 21*b* on the trailing end side of the suction plate 21 against the trailing end pressed member 26*a*. The trailing end pressing member 26*d* is held by one end of a spring 26*c*. The trailing end pressed member 26*a* is rotatably supported and biased toward the trailing end pressing member 26*d* by a spring 26*b*. The attached portion 21*b* on the trailing end side of the suction plate 21 is sandwiched and secured between the trailing end pressing member 26*d* and the trailing end pressed member 26*a* by biasing forces of the spring 26*b* and 26*c*.

A leading end and a trailing end, in the conveyance direction, of the suction plate 21 are sandwiched and secured by the securing portions 25 and 26, respectively. The suction plates 21 are thus attached to the drum body 22. To remove the suction plate 21, the trailing end pressed member 26*a* is rotated clockwise in the drawing to release the sandwiching and securing of the attached portion 21*b* on the trailing end side of the suction plate 21. The attached portion 21*b* on the trailing end side of the suction plate 21 is then removed from the suction plate trailing end securing portion 26. The attached portion 21*b* on the leading end side of the suction plates 21 is pulled out of the suction plate leading end securing portion 25. The suction plate 21 is accordingly detached from the drum body 22.

To attach the suction plate 21 to the drum body 22, the attached portion 21*b* on the leading end side of the suction plate 21 is inserted between the leading end pressed member 25*a* and the leading end pressing member 25*c*. The trailing end pressed member 26*a* is rotated clockwise in the drawing to insert the attached portion 21*b* on the trailing end side of the suction plate 21 between the trailing end pressed member 26*a* and the trailing end pressing member 26*d*. The trailing end pressed member 26*a* is then released. The trailing end pressed member 26*a* accordingly rotates counterclockwise in the drawing by the biasing force of the spring 26*b*. The attached portion 21*b* on the trailing end side of the suction plates 21 is thus sandwiched and secured between the trailing end pressed member 26*a* and the trailing end pressing member 26*d*.

Figure 10A:
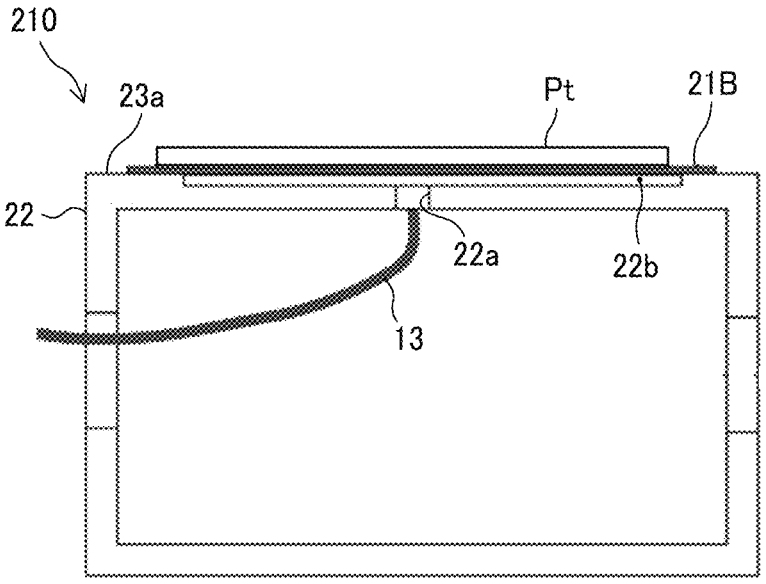
FIG. 10A is a view illustrating a situation where the rigid suction plate is attached to the drum body.
Figure 10B:
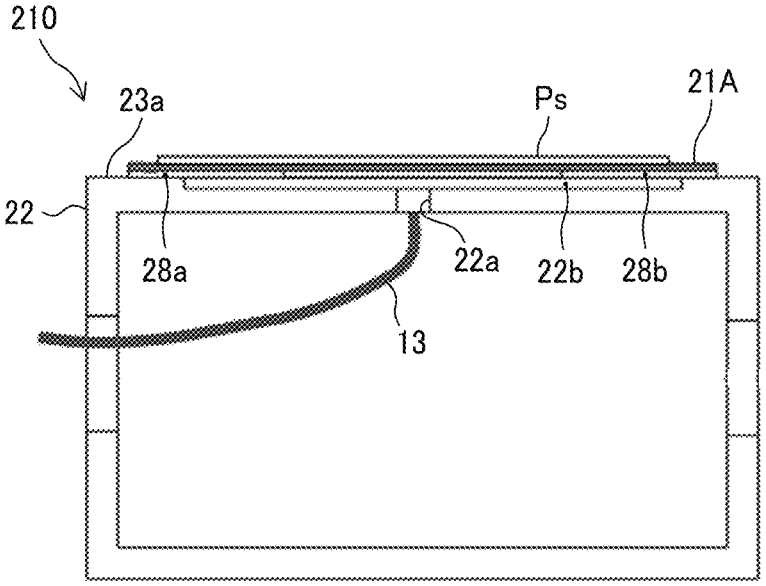
FIG. 10B is a view illustrating a situation where the flexible suction plate is attached to the drum body.

FIG. 10A illustrates a situation where the rigid suction plate 21B illustrated in FIG. 8A is attached to the drum body 22. FIG. 10B illustrates a situation where the flexible suction plate 21A is attached to the drum body 22.

The flexible suction plates 21A are attached to the drum body 22 when double-sided printing is to be performed on a sheet such as thin paper, on which end waviness may occur after passing through the drying unit 300. The rigid suction plates 21B are attached to the drum body 22 at other cases than the double-sided printing.

The spacers 28*a* and 28*b* are not attached at both the ends, in the width directions, of the rigid suction plate 21B. A distance between the rigid suction plate 21B and the bottom surface of the chamber 22*b* is thus shorter, compared with a case of the flexible suction plate 21A in which the spacers 28*a* and 28*b* are attached at both the ends in the width directions, as illustrated in FIG. 10B. The rigid suction plate 21B has rigidity that does not allow bending even when the suction force of the suction device 211 is applied. Even when the suction device 211 brings a sheet such as a thick sheet Pt into close contact with the outer circumferential surface of the sheet carrying drum, the rigid suction plate 21B does not come close to the bottom surface of the chamber 22*b*. Even when there is no spacer, the suction grooves 22*a* therefore preferably allow air to be sucked.

The rigid suction plate 21B does not bend even when the suction force of the suction device 211 is applied. The state illustrated in FIG. 10A is maintained. That is, a flat state in the width directions is maintained. The thick sheet Pt having strong stiffness is accordingly prevented from being concavely deformed in the width directions. The thick sheet Pt is thus brought into close contact with the outer circumferential surface of the sheet carrying drum.

The rigid suction plate 21B is flat in the width directions. A distance between the sheet and the nozzle of the liquid discharge head is substantially constant in the width directions. Disturbance in linearity of printing and contamination due to satellite scattering are suppressed. A high-quality image is thus acquired.

When double-sided printing is to be performed on a sheet such as thin paper, on which end waviness may occur after passing through the drying unit 300, the rigid suction plates 21B attached to the drum body 22 are removed. Instead, the flexible suction plates 21A are attached to the drum body 22. The flexible suction plate 21A bends from the state illustrated in FIG. 10B by the suction force of the suction device 211 and becomes the state illustrated in FIG. 6. Providing the spacers 28*a* and 28*b* to increase a distance from the bottom surface of the chamber 22*b* to the flexible suction plate 21A therefore prevents the flexible suction plate 21A from coming into contact with the bottom surface of the chamber 22*b* and blocking the suction grooves 22*a*. As described above, attaching the flexible suction plates 21A to the drum body 22 makes it possible to bring a sheet, which has been concaved in the width directions by the suction force of the suction device 211 and end waviness has occurred, into close contact with the outer circumferential surface of the sheet carrying drum while suppressing occurrence of wrinkles at the ends.

A sheet conveyor (10) includes: a drum (210) to: carry a sheet on a circumferential surface of the drum; and rotate to convey the sheet; and adhering part (211) to adhere the sheet to the circumferential surface of the drum (210), wherein the drum (210) has: both end parts in an axial direction of the drum (210), the both end parts each having a first outer diameter in a radial direction orthogonal to the axial direction; and a center part between the both end parts in the axial direction of the drum (210), the center part having a second outer diameter smaller than the first outer diameter in the radial direction.

The both end parts of the drum (210) respectively face both ends of the sheet in a width direction of the sheet parallel to the axial direction, the center part of the drum (210) faces a center of the sheet in the width direction, and the first outer diameter of each of the both end parts is larger than the second outer diameter of the center part in the radial direction.

The drum (210) includes a suction plate (21) having multiple suction holes (21*a*) on a circumferential surface of the suction plate, and the adhering part (211) includes a suction pump (211) to suck the sheet through the multiple suction holes (21*a*).

The drum (210) further includes a cylinder (22), and the suction plate (21) is flexibly attached to a circumferential surface of the cylinder (22) to allow the center of the sheet, adhered to the suction plate (21), in a width direction of the sheet to be concaved toward the center part of the drum (210).

The both end parts of the drum (210) respectively have spacers (28*a*, 28*b*), and the spacers (28*a*, 28*b*) are disposed between the suction plate (21) and the circumferential surface of the cylinder (22) in the radial direction.

The suction plate (21) is detachably attachable to the cylinder (22), and the suction plate (21) has rigidity undeformed by a suction force of the suction pump (211).

The drum (210) rotates in a conveyance direction to convey the sheet, the drum (210) has multiple suction regions (23*a*, 23*b*, 23*c*) divided in a circumferential direction of the drum, the drum (210) sequentially sucks the sheet in each of the multiple suction regions (23*a*, 23*b*, 23*c*) from a downstream side of the multiple suction regions (23*a*, 23*b*, 23*c*) in the conveyance direction.

An image forming apparatus includes the sheet conveyor (10).

The above-described embodiment is illustrative and does not limit the present embodiment. Thus, numerous additional modifications and variations are possible in light of the above teachings. For example, elements and/or features of different illustrative embodiments may be combined with each other and/or substituted for each other within the scope of the present embodiment.

The above-described embodiment is a limited example, and the present embodiment includes, for example, the following aspects having advantageous effects.

First Aspect

According to a first aspect, the sheet conveyor 10 includes: a conveying drum such as the sheet carrying drum 210 that carries a sheet on a circumferential surface, rotates, and conveys the sheet; and close-contact means such as the suction device 211 that brings the sheet into close contact with the circumferential surface of the conveying drum, in which, on the circumferential surface of the conveying drum, an outer diameter at each of both ends is larger than an outer diameter at a center.

Margins in which no image is to be formed are generally provided at both the ends, in the width directions, of a sheet. When the sheet passes through a dryer, however, an image region at a center, in the width directions, of the sheet, on which an image is formed, contracts more than margin regions at the ends, in the width directions, of the sheet. As a result, a length in the sheet conveyance direction at each of the ends, in the width directions, of the sheet becomes longer than a length at the center, distortion occurs, and waviness (referred to as end waviness) may occur at both the ends, in the width directions, of the sheet. When a sheet is thin paper having a thinner thickness, in particular, end waviness is likely to occur due to the distortion described above.

In a case where an outer diameter of the conveying drum is constant in the directions of the rotation axis of the conveying drum (also in the width directions of a sheet), and when double-sided printing is to be performed, the sheet is conveyed to the sheet conveyor again, and the sheet, on which end waviness has occurred, is brought into close contact with the circumferential surface of the conveying drum, wrinkles may be generated at the ends, in the width directions, of the sheet.

In the first aspect, making an outer diameter at each of both the ends of the circumferential surface of the conveying drum larger than an outer diameter at the center makes a circumferential length at each of both the ends becomes longer than a circumferential length at the center. The center and both the ends, in the width directions, of the sheet are in close contact at identical positions, in the circumferential directions, on the conveying drum. However, the circumferential length at each of both the ends, in the width directions, of the conveying drum is longer than the circumferential length at the center. The ends, in the width directions, of the sheet are thus pulled in the conveyance direction, and are in close contact. Even when a length, in the sheet conveyance direction, at each of the ends, in the width directions, of a sheet is longer than a length at the center, and waviness has occurred on the sheet at both the ends in the sheet width directions, the sheet therefore comes into close contact with the circumferential surface of the conveying drum in a state where the ends, in the width directions, of the sheet are stretched in the sheet conveyance direction and the waviness is eliminated. The sheet is thus three-dimensionally fitted to the circumferential surface of the conveying drum. It is accordingly possible to suppress occurrence of wrinkles at the ends of a sheet.

Second Aspect

According to a second aspect, in the sheet conveyor 10 of the first aspect, an outer diameter at a part of the circumferential surface of the conveying drum such as the sheet carrying drum 210, which faces each of the ends, in the sheet width directions, of the sheet, is larger than an outer diameter at a part facing the center, in the sheet width directions, of the sheet.

According to this configuration, as described in the present embodiment, even when a length in the sheet conveyance direction at each of the ends, in the sheet width directions, of a sheet is longer than a length at the center, and waviness has occurred on the sheet at both the ends in the sheet width directions, it is possible to three-dimensionally fit the sheet to the circumferential surface of the conveying drum. It is thus possible to suppress occurrence of wrinkles at the ends of the sheet.

Third Aspect

According to a third aspect, in the sheet conveyor 10 of the first or second aspect, the close-contact means is suction means such as the suction device 211 that sucks a sheet through the plurality of suction holes 21*a* provided on the circumferential surface of the conveying drum such as the sheet carrying drum 210.

According to this configuration, as described in the present embodiment, it is possible to bring a sheet into close contact with the circumferential surface of the sheet carrying drum.

Fourth Aspect

According to a fourth aspect, in the sheet conveyor 10 of the third aspect, the conveying drum such as the sheet carrying drum 210 includes the drum body 22 having a cylindrical shape and flexible members such as the suction plates 21 that are attached to the drum body 22 and forms the circumferential surface having the plurality of suction holes 21*a*, and the flexible members are attached to the conveying drum to allow the center in the sheet width directions to be concaved.

According to this configuration, as described in the present embodiment, the center, in the sheet width directions, of each of the flexible members such as the suction plates 21 is concaved by the suction force of the suction means such as the suction device 211. It is thus possible to make the outer diameter at each of the ends, in the sheet width directions, of the sheet on the circumferential surface of the conveying drum larger than the outer diameter of the part facing the center, in the sheet width directions, of the sheet.

Fifth Aspect

According to a fifth aspect, in the sheet conveyor 10 of the fourth aspect, both the ends, in the sheet width directions, of each of the flexible members such as the suction plates 21 are attached to the drum body 22 via the spacers 28*a* and 28*b*.

According to this configuration, as described in the present embodiment, it is possible to prevent, when the center, in the sheet width directions, of each of the flexible members such as the suction plates 21 is concaved by the suction force of the suction means such as the suction device 211, the flexible member from blocking the suction grooves 22*a* provided on the bottom surface of the chamber 22*b*.

Sixth Aspect

According to a sixth aspect, in the sheet conveyor 10 of the fourth or fifth aspect, the flexible members such as the flexible suction plates 21A are attachable to and detachable from the drum body 22, and the flexible members are replaceable with rigid members such as the rigid suction plates 21B that form the circumferential surface having the plurality of suction holes and being flat in the width directions and that each have rigidity that does not allow the circumferential surface to be bent by the suction force of the suction means.

According to this configuration, when a sheet has strong stiffness and is difficult to come into close contact with the circumferential surface having a concaved shape in the sheet width directions, such as thick paper, it is possible to remove the flexible members such as the flexible suction plates 21A from the drum body 22 and to replace the flexible members with rigid members such as the rigid suction plates 21B each having a circumferential surface that is flat in the width directions. Using the rigid members makes it possible to preferably prevent bending by the suction force of the suction device such as the suction means, prevent the circumferential surface from being concaved into a concaved shape in the sheet width directions, and bring a sheet having strong stiffness into close contact.

Seventh Aspect

According to a seventh aspect, in the sheet conveyor 10 of any one of the third to sixth aspects, the sheet carrying regions for carrying the sheet on the conveying drum such as the sheet carrying drum 210 are each divided into the plurality of suction regions 24A to 24D, in the circumferential directions, on the conveying drum, and the sheet is sequentially sucked in each of the suction regions from the downstream side in the sheet conveyance direction.

According to this configuration, as described in the present embodiment, it is possible to gradually straighten and stretch waviness at the ends of a sheet, from its leading end side of the sheet in which the waviness has occurred at the ends, to bring the sheet into close contact with the outer circumference of the conveying drum. It is thus possible to preferably suppress occurrence of wrinkles at the ends of the sheet.

Eighth Aspect

According to an eighth aspect, the image forming apparatus includes the sheet conveyor of any one of the first to seventh aspects.

According to this configuration, it is possible to suppress generation of wrinkles at the ends of a sheet when performing double-sided printing.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The invention claimed is:

1. A sheet conveyor comprising:

a drum to:

carry a sheet on a circumferential surface of the drum; and rotate to convey the sheet; and an adhering part to adhere the sheet to the circumferential surface of the drum by a suction force, wherein the drum has:

both end parts in an axial direction of the drum, the both end parts each having a first outer diameter in a radial direction orthogonal to the axial direction;

a center part between the both end parts in the axial direction of the drum, the center part having a second outer diameter smaller than the first outer diameter in the radial direction; and flexible suction plates which concavely bend, by the suction force, in the axial direction.

2. The sheet conveyor according to claim 1, wherein the both end parts of the drum respectively face both ends of the sheet in a width direction of the sheet parallel to the axial direction, the center part of the drum faces a center of the sheet in the width direction, and the first outer diameter of each of the both end parts is larger than the second outer diameter of the center part in the radial direction.

3. The sheet conveyor according to claim 1, wherein the drum includes a suction plate having multiple suction holes on a circumferential surface of the suction plate, and the adhering part includes a suction pump to suck the sheet through the multiple suction holes.

4. The sheet conveyor according to claim 3, wherein the drum further includes a cylinder, and the suction plate is flexibly attached to a circumferential surface of the cylinder to allow a center of the sheet, adhered to the suction plate, in a width direction of the sheet to be concaved toward the center part of the drum.

5. The sheet conveyor according to claim 4, wherein the both end parts of the drum respectively have spacers, and the spacers are disposed between the suction plate and the circumferential surface of the cylinder in the radial direction.

6. The sheet conveyor according to claim 4, wherein the suction plate is detachably attachable to the cylinder, and the suction plate has rigidity undeformed by a suction force of the suction pump.

7. The sheet conveyor according to claim 3, wherein the drum rotates in a conveyance direction to convey the sheet, the drum has multiple suction regions divided in a circumferential direction of the drum, the drum sequentially sucks the sheet in each of the multiple suction regions from a downstream side of the multiple suction regions in the conveyance direction.

8. The sheet conveyor according to claim 7, further comprising a rotary valve disposed between the adhering part and the drum to switch suction airflow among the multiple suction regions.

9. The sheet conveyor according to claim 3, wherein the drum further includes at least one chamber and at least one suction groove formed at a bottom of the at least one chamber, and the multiple suction holes communicate with the at least one suction groove through the at least one chamber.

10. An image forming apparatus comprising the sheet conveyor according to claim 1.

11. The sheet conveyor according to claim 1, wherein the flexible suction plates are detachably attachable to the drum.

12. The sheet conveyor according to claim 11, wherein the flexible suction plates are replaceable with rigid suction plates having rigidity that does not allow bending by the suction force.

13. The sheet conveyor according to claim 1, wherein the drum has three sheet carrying regions divided in a circumferential direction of the drum, each of the three sheet carrying regions being configured to carry a sheet.

14. The sheet conveyor according to claim 1, wherein the drum further includes a sheet gripper to grip a leading end of the sheet.

15. The sheet conveyor according to claim 1, further comprising a pressing roller to press the sheet against the circumferential surface of the drum.

16. A sheet conveyor comprising:

a drum to:

carry a sheet on a circumferential surface of the drum; and rotate to convey the sheet; and an adhering part to adhere the sheet to the circumferential surface of the drum, wherein the drum includes:

both end parts in an axial direction of the drum, the both end parts each having a first outer diameter in a radial direction orthogonal to the axial direction;

a center part between the both end parts in the axial direction of the drum, the center part having a second outer diameter smaller than the first outer diameter in the radial direction;

a suction plate having multiple suction holes on a circumferential surface of the suction plate; and a cylinder, the adhering part includes a suction pump to suck the sheet through the multiple suction holes, the suction plate is flexibly attached to a circumferential surface of the cylinder to allow a center of the sheet, adhered to the suction plate, in a width direction of the sheet to be concaved toward the center part of the drum, and the both end parts of the drum respectively have spacers which are disposed between the suction plate and the circumferential surface of the cylinder in the radial direction.

* * * * *